United States Patent [19]

Monma et al.

[11] 4,228,938

[45] Oct. 21, 1980

[54] PAPER FEED CONTROL SYSTEM IN A PRINTER

[75] Inventors: Hisayoshi Monma; Shigenobu Katagiri; Hiroomi Kozawa, all of Katsuta, Japan

[73] Assignee: Hitachi Koki Company Limited, Tokyo, Japan

[21] Appl. No.: 923,240

[22] Filed: Jul. 10, 1978

[51] Int. Cl.[3] ..... B65H 25/10

[52] U.S. Cl. ..... 226/9; 400/583.1

[58] Field of Search ..... 226/9; 400/583.1, 583.4, 400/67, 70, 183

[56] References Cited

U.S. PATENT DOCUMENTS

| | | | |
|---|---|---|---|
| 2,831,561 | 4/1958 | Speh | 226/9 |
| 3,042,178 | 7/1962 | West | 400/583.1 |
| 3,174,610 | 3/1965 | Barbagallo et al. | 226/9 X |
| 3,498,514 | 3/1970 | Howard et al. | 226/9 |
| 3,524,528 | 8/1970 | Peyton | 400/583.1 |
| 3,601,297 | 8/1971 | Funk et al. | 226/9 |
| 3,606,118 | 9/1971 | Piccione | 226/9 |
| 3,644,812 | 2/1972 | Bitto et al. | 400/583.1 X |
| 3,926,292 | 12/1975 | Ramsden, Jr. | 400/583.1 X |

FOREIGN PATENT DOCUMENTS

| | | | |
|---|---|---|---|
| 1177184 | 1/1970 | United Kingdom | 400/583.1 |

*Primary Examiner*—Stanley N. Gilreath

*Attorney, Agent, or Firm*—Fulwider, Patton, Rieber, Lee & Utecht

[57] ABSTRACT

In a paper feed control system employing a pulse motor steppingly rotatable in response to driving pulses, paper feeding is controlled by a prepunched format tape wherein line pulses generated every one line feeding of the paper are in synchronism with perforations detected from the format tape. Briefly, the format tape is moved by the pulse motor, and when a first perforation is detected therefrom a predetermined number of the driving pulses is applied to the pulse motor, whereby the format tape is moved to an approximate midpoint of the perforation. A first line pulse is generated in response to the predetermined number of the driving pulses so that the line pulse is generated in approximate midpoint of the first perforation. Accordingly, the succeeding line pulses are generated in the approximate midpoints of the succeeding perforations.

3 Claims, 7 Drawing Figures

| PHASE \ STEP | 1 | 2 | 3 | 4 | 5 | 6 | 7 | 8 |
|---|---|---|---|---|---|---|---|---|
| I | | | ▨ | ▨ | | | ▨ | ▨ |
| II | ▨ | | | ▨ | ▨ | | | ▨ |
| III | ▨ | ▨ | | | ▨ | ▨ | | |
| IV | | ▨ | ▨ | | | ▨ | ▨ | |

PAPER FEED CONTROL SYSTEM IN A PRINTER

BACKGROUND OF THE INVENTION

This invention relates to a paper feed control system in a printer, such as line printer. More specifically, it relates to a paper feed control system in which the feeding operation of a printing paper is controlled by a format tape.

In the printer system, it is known in the art to control the feeding operation of the printing paper by the format tape. One of such examples is disclosed in the U.S. Pat. No. 3,042,178. The typical format tape has twelve channels along the direction of its advance and a plurality of rows perpendicular to the channels. A perforation is punched in the intersection of a preselected row and channel of the format tape, which defines a printing form in the printing paper. The format tape is moved by a motor, such as servo motor, until the perforation is sensed at the senser, and the printing paper is advanced an amount equal to the movement of the format tape. In this case, it is necessary that the perforation should be sensed in synchronism with a line pulse generated every one line advancement of the printing paper. In the type having an encoder directly secured to a paper feeding shaft, it is the general practice to adjust the position of the senser so that the line pulse obtained from the encoder is generated in an approximate midpoint of the perforation.

However, there is an inconvenience in the printer system employing a pulse motor. In such a printer system, the line pulse is not generated from the encoder but generated when a predetermined number of driving pulses applied to the pulse motor is counted. It is now assumed that a four-phase pulse motor is employed, where adjacent two phases are excited and the I–II phases are excited when the power supply is switched on. When one driving pulse is applied to the motor after the power supply is switched on, the II–III phases are excited. In this manner, with one driving pulse the adjacent two phases are excited in turn. The line pulse is assumed to be generated when eight driving pulses are counted. Then, as can be appreciated from FIG. 6, the excitation for the I–II phases will take place twice during one line advancement of the printing paper. Therefore, depending on which I–II phases are excited at the time when the power supply is switched on, the generation of the line pulse may be displaced an amount corresponding to a half line of the printing paper. As a result, the line pulse may be generated in the position between the adjacent lines to be printed, whereby the line pulse is not generated in synchronism with the perforation in the format tape.

Shown in FIG. 3 is a timing chart explaining the paper feeding operation according to the pulse motor. Driving pulses for switching the excited phases of the pulse motor are generated when a feed signal for feeding the printing paper is in "1" state and the pulse motor is driven in response to the driving pulses. When the eighth driving pulse is generated, one line pulse is generated. The thus generated line pulse causes to stop the feeding of the printing paper provided that the perforation signal is in "1" state. That is, when the perforation signal is in "1" state and immediately after the line pulse is generated, the feed signal is put in "0" state, whereby the pulse motor is stopped after the rotation responsive to the eighth driving pulse.

SUMMARY OF THE INVENTION

Accordingly, an object of this invention is to provide a paper feed control system employing the pulse motor in which the aforementioned disadvantage is eliminated. Briefly, and in accordance with this invention, the format tape is moved by the pulse motor, and when a first perforation is detected therefrom a predetermined number of the driving pulses is applied to the pulse motor, whereby the format tape is moved to an approximate midpoint of the perforation. A first line pulse is generated in response to the predetermined number of the driving pulses so that the line pulse is generated in approximate midpoint of the first perforation. Accordingly, the succeeding line pulses are generated in the approximate midpoints of the succeeding perforations.

BRIEF DESCRIPTION OF THE DRAWINGS

In the drawings:

FIG. 2(*b*) is a sectional view cut along A–A' of FIG. 2(*a*);

DETAILED DESCRIPTION OF A PREFERRED EMBODIMENT

One embodiment according to this invention will now be described with reference to the accompanying drawings.

Figure 1:
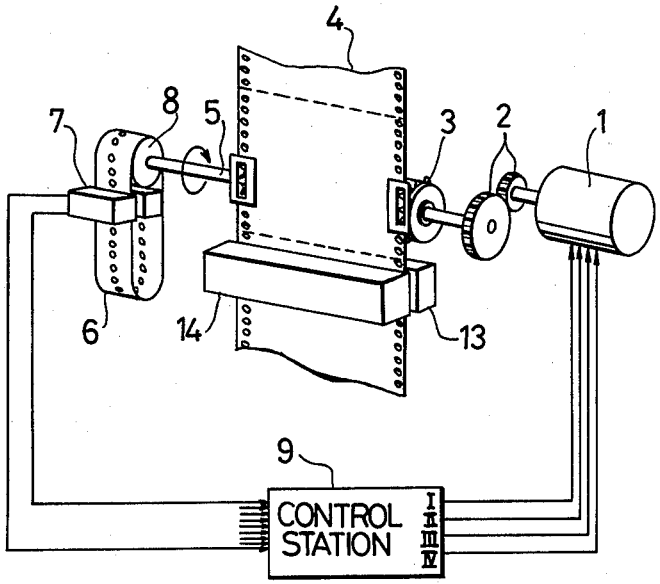
FIG. 1 is a partial perspective view showing a paper feed control system according to this invention.

Shown in FIG. 1 is a partial perspective view of a paper feed control system adapted to be utilized in this invention. When the pulse motor 1 is driven, a tractor 3 is rotated via gear means 2 to advance the printing paper 4 and a sprocket 8 is rotated about a shaft 5 connected to the tractor 3. In this construction, the printing paper 4 and the format tape 6 are fed at the same speed. Reference numerals 13 and 14 designate print hammers and a print carrier, respectively. A control station 9 will be described in detail later on.

Figures 2A, 2B:
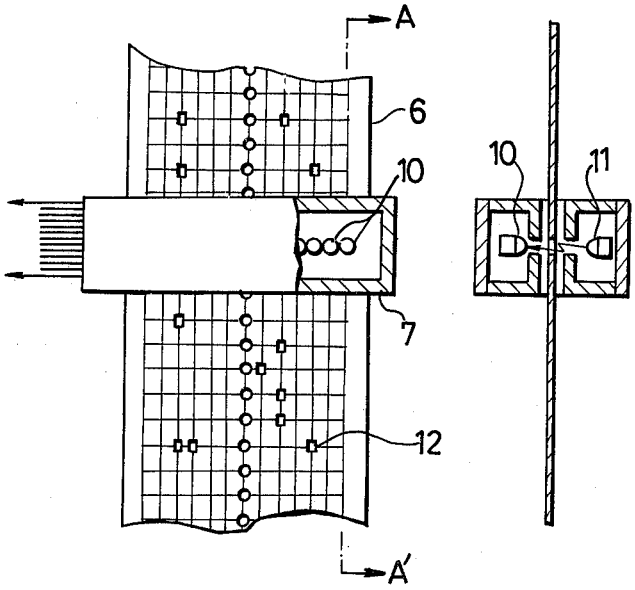
FIG. 2(*a*) is an enlarged partially sectioned view showing a format tape and perforation sensing devices employed in the paper feed contro system shown in FIG. 1.
Figure 3:
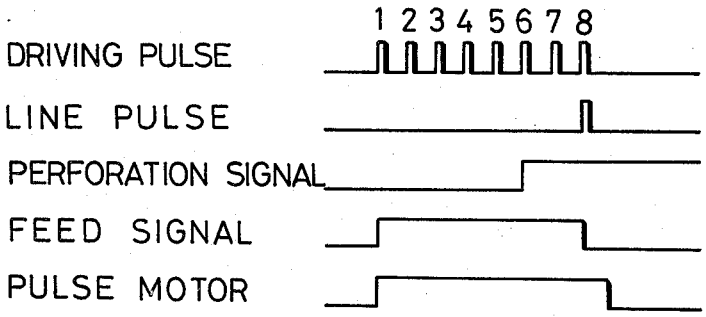
FIG. 3 is a timing chart showing the case that one line feeding is effected by the pulse motor.

Shown in FIG. 2(*a*) is an enlarged view showing the format tape 6 and a perforation sensing means 7 comprising light emitting elements 11, e.g. LEDs (light emitting diodes) and light receiving elements 10, e.g. photo-diodes. The perforation 12 is punched in the intersection of a preselected channel and row of the format tape 6. FIG. 2(*b*) is a sectional view of the format tape 6 and the perforation sensing means 7 shown in FIG. 2(*a*).

Figure 4:
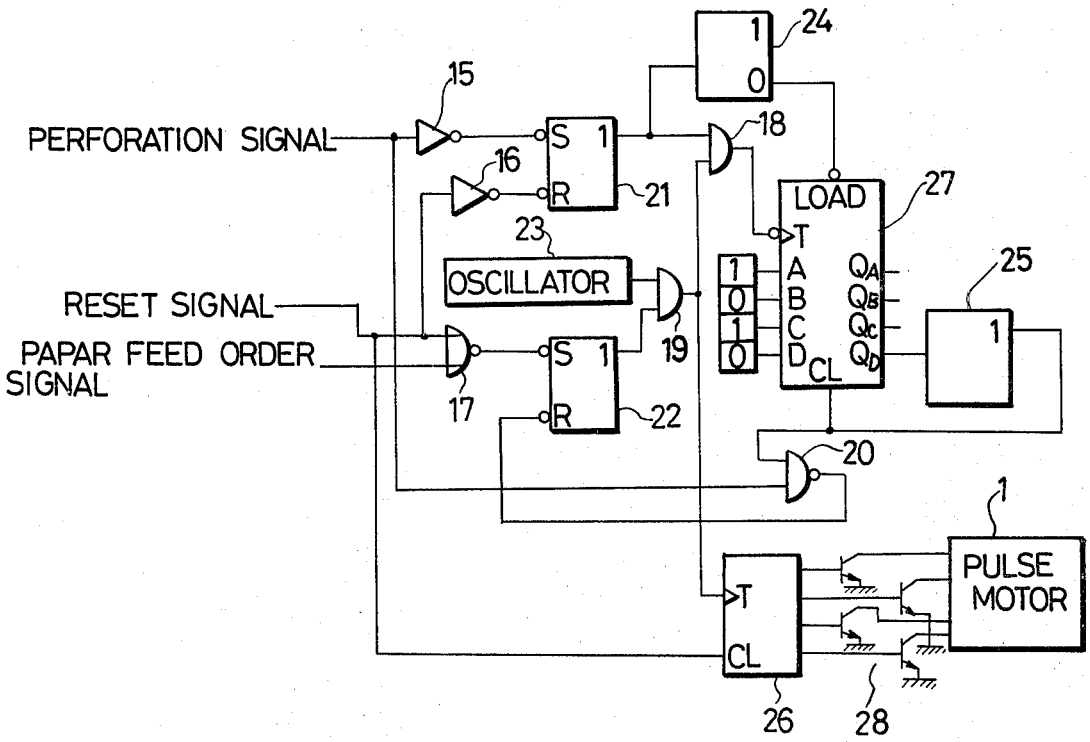
FIG. 4 is a block diagram showing one embodiment of the paper feed control system according to this invention.
Figures 5, 6:
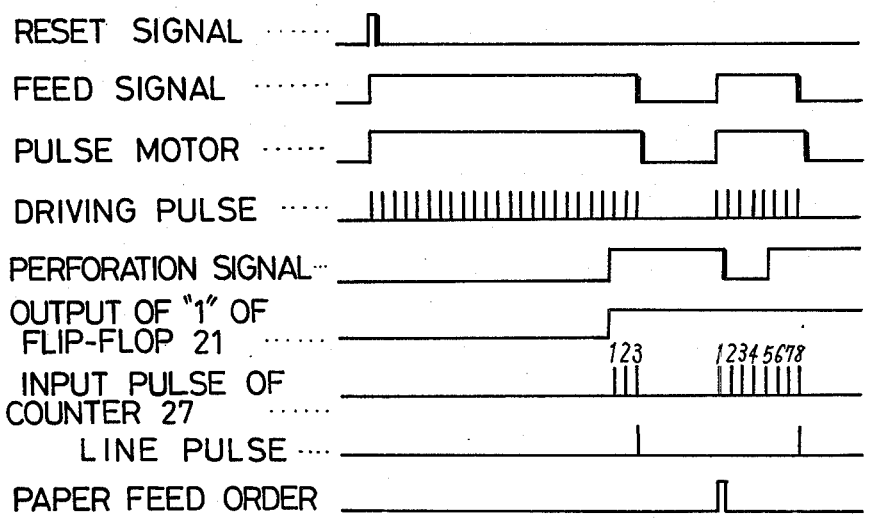
FIG. 5 is a timing chart explaining the operation of the control system shown in FIG. 4.
FIG. 6 is a diagram explaining the operational principle of the four-phase pulse motor of two-phase excitation, in which the hatched portions denote the excited phases.

Referring now to FIGS. 4 and 5, a synchronizing method according to this invention will be described. When a power supply is switched on, a reset signal is generated, which will reset a flip-flop 21 through an invertor 16 and concurrently set a flip-flop 22 through a NOR gate 17. When the flip-flop 22 is set, its "1" terminal is put in "1" state and a feed signal is supplied therefrom. The "1" terminal of the flip-flop 22 is connected to one input terminal of an AND gate 19 and an oscillator 23 is connected to the other input terminal thereof. A series of pulses is produced in the oscillator 23, so that the AND gate 19 is rendered conductive when the feed signal is in "1" state. The pulses obtained from the output of the AND gate 19 (which will be hereinafter referred to as "driving pulses") are applied to the trigger terminal T of a ring counter 26. A driving circuit 28 comprising at least four transistors is energized in response to the output of the ring counter 26, thereby causing the pulse motor 1 to drive. Although the driving pulses are also applied to one input terminal of and AND gate 18, the AND gate 18 is not opened until the perforation is sensed from the moving format tape and the flip-flop 21 is put in set condition. Therefore, the driving pulses are not applied through the AND gate 18 to a trigger input terminal T of a counter means 27. Due to the rotation of the pulse motor 1, the format tape is moved. When a first perforation punched in a preselected channel is sensed, the flip-flop 21 is set through an invertor 15 and instantaneously a monomultivibrator 24 is triggered to cause the counter means 27 to be loaded a decimal digit of "5" by means of a four-bit binary counter (ABCD). More specifically, the stages A and C corresponding to $2^0$ and $2^2$, respectively, become "1" state while the stages B and D corresponding to $2^1$ and $2^3$, respectively, are in "0" state. $Q_A$, $Q_B$, $Q_C$ and $Q_D$ are also the stages of a four-bit binary counter, which correspond to the stages of A, B, C and D, respectively. Thus, when the decimal digit of "5" is loaded in the counter means 27, the stages of $Q_A$ and $Q_C$ corresponding to $2^0$ and $2^2$, respectively, become "1" state and the stages $Q_B$ and $Q_D$ corresponding to $2^1$ and $2^3$, respectively, are in "0" state. When the flip-flop 21 is set and thus the AND gate 18 is fully enabled, the counter means 27 starts counting the driving pulses. At the time when the counter means 27 receives the third driving pulse, the count number in the counter means 27 becomes totally "8" in decimal digit. That is, the stage $Q_D$ corresponding to $2^3$ is put in "1" state and counter means 27 produces its output from the terminal connected to the stage $Q_D$ to thereby cause a monomultivibrator 25 to trigger, whereby a line pulse is generated from the terminal "1" of the monomultivibrator 25. When the line pulse is generated, the counter means 27 is cleared and the flip-flop 22 is reset in response to the output of a NAND gate 20, as a result of which the feed signal is put in "0" state and accordingly the pulse motor 1 is stopped, since the AND gate 19 is closed and no driving pulses are applied to the ring counter 26.

Once the flip-flop 21 is set in response to the first perforation, the flip-flop 21 maintains its set condition. Accordingly, the monomultivibrator 24 will not be triggered in response to the subsequent perforations. The counter means 27 produces its output upon counting the eighth driving pulses with respect to the perforations subsequent to the first perforation.

Similar to the aforementioned operation, when a paper feed order signal is applied to one input terminal of the NOR gate 17, the flip-flop 22 is set and the driving pulses are applied to the ring counter 26 to thereby drive the pulse motor 1. The pulse motor 1 is stopped if the perforation is sensed at the time when the line pulse is produced.

In the above-described embodiment, when the format tape is continuously moved, the perforation is sensed from the format tape for the period corresponding to about three fourth of the duration of successive eight driving pulses. Therefore, the line pulse is generated in the approximate midpoint of the perforation. The duration of "1" state in the perforation signal as shown in FIG. 5 is depicted longer than the duration of succeeding eight driving pulses due to the fact that the format tape is stopped for a while immediately after the line pulse is generated.

In the above embodiment, it is still possible to set the flip-flop 22 by a manual switch, whereby the synchronization between the line pulse and the perforation can be effected at any time after the power supply is switched on.

What is claimed is:

1. In a paper feed control system control system employing a prepunched format tape containing perforations arranged thereon in a direction of tape advancement for controlling paper feed, perforation sensing means for detecting perforations in said tape as said tape advances and for providing perforation signals, driving pulse generating means for generating driving pulses, a pulse motor steppingly rotatable in response to said driving pulses applied thereto to proportionately advance a printing paper whereat a line pulse is produced every one line advancement of said printing paper, means reponsive to advancement of said printing paper to proportionately advance said tape, and a control station responsive to external feed command signals and to said perforation signals to provide said driving pulses and said line pulses, the improvement comprising: means for counting said driving pulses and for producing said line pulse upon counting a first predetermined number of driving pulses, driving pulse gating means for preventing said driving pulses from being applied to said pulse motor when said line pulse and one of said perforation signals are coincidentally provided and for permitting said driving pulses to be applied thereto in response to said external feed command signals, and means responsive to actuation of said control station and the receipt of said perforation signal to preload said counting means with a second predetermined number of driving pulses less than said first predetermined number of driving pulses, whereby each of said line pulses is generated in the approximate midpoint of each of said perforation signals.

2. A paper feed control system according to claim 1 wherein said means for counting and for producing a line pulse includes a binary counter with clearing input and a plurality of output stages corresponding to binary bit positions, and a line pulse generator is connected to an output stage of said binary counter to produce line pulses, and connected to said gating means and to said clearing input of said binary counter, whereby said line pulses clear said binary counter.

3. A paper feed control system as claimed in claim 2 wherein said line pulse generator is a monomultivibrator.

* * * * *

UNITED STATES PATENT AND TRADEMARK OFFICE

CERTIFICATE OF CORRECTION

PATENT NO. : 4,228,938

DATED : October 21, 1980

INVENTOR(S) : Hisayoshi Monma et al.

It is certified that error appears in the above—identified patent and that said Letters Patent is hereby corrected as shown below:

Column 2, line 25, "contro" should read -- control --.

Column 3, line 16, "ahd" should read -- an --.

Column 4, line 55, insert the word -- a -- after the word "with".

Signed and Sealed this

*Twenty-sixth* Day of *May 1981*

[SEAL]

*Attest:*

RENE D. TEGTMEYER

*Attesting Officer*

*Acting Commissioner of Patents and Trademarks*

UNITED STATES PATENT AND TRADEMARK OFFICE

CERTIFICATE OF CORRECTION

PATENT NO. : 4,228,938

DATED : Oct. 21, 1980

INVENTOR(S) : Hisayoshi Monma et al.

It is certified that error appears in the above—identified patent and that said Letters Patent is hereby corrected as shown below:

On the title page the following should be added:

-- [30] Foreign Application Priority Data

July 13, 1977 Japan .....88692/77 --.

Signed and Sealed this

Sixth Day of April 1982

[SEAL]

Attest:

GERALD J. MOSSINGHOFF

Attesting Officer

Commissioner of Patents and Trademarks